US006189150B1

(12) United States Patent
Jones-Roberson

(10) Patent No.: US 6,189,150 B1
(45) Date of Patent: Feb. 20, 2001

(54) COSMETOLOGY THERMAL STYLING GLOVE

(75) Inventor: Yolanda Yvette Jones-Roberson, Houston, TX (US)

(73) Assignee: Yolanda Jones-Roberson, Houston, TX (US)

( * ) Notice: Under 35 U.S.C. 154(b), the term of this patent shall be extended for 0 days.

(21) Appl. No.: 09/363,444

(22) Filed: Jul. 29, 1999

Related U.S. Application Data

(60) Provisional application No. 60/106,576, filed on Nov. 2, 1998.

(51) Int. Cl.[7] ..... A41D 19/00
(52) U.S. Cl. ..... 2/163; 2/159
(58) Field of Search ..... 2/159, 161.1, 161.2, 2/161.4, 161.5, 161.6, 163, 167, 170, 16, 20, 917, 920; D2/617

(56) References Cited

U.S. PATENT DOCUMENTS 2,025,710 * 12/1935 Beemer ..... 2/159
2,928,102 * 3/1960 Canausa ..... 2/161.1
3,394,408 * 7/1968 Bush ..... 2/161.1
4,185,330 * 1/1980 Stager ..... 2/164
4,689,828 * 9/1987 Brewer ..... 2/21
4,751,747 * 6/1988 Banks et al. ..... 2/21
5,140,709 * 8/1992 Cohn et al. ..... 2/163
5,826,595 * 10/1998 Ramm et al. ..... 2/132

* cited by examiner

*Primary Examiner*—John J. Calvert
*Assistant Examiner*—Katherine Moran

(57) ABSTRACT

A cosmetology thermal styling glove is used for all types of thermal styling to minimize burning of the thumb, the first finger, the palm side the back side, and the web portions of the uncovered fingers that hold the hair that is being thermal styled. The glove covers the thumb, the first finger, the palm side, the back side, and the web portions, while the middle finger, the ring finger and the pinkie fingers are uncovered allowing these fingers to be in contact with the hair. The glove is particularly suitable for cosmetologist, beauticians, and hair stylist or by those who thermal style their own hair. It is placed on the hand not holding the thermal styling tool.

8 Claims, 4 Drawing Sheets

COSMETOLOGY THERMAL STYLING GLOVE

CROSS REFERENCE TO RELATED APPLICATIONS

This is an application claiming priority of Provisional Application No. 60/106,576 filed Nov. 2, 1998 titled Cosmetologist Thermal Styling Glove.

BACKGROUND OF THE INVENTION

The present invention relates generally to gloves and more particularly, to a glove which exposes selected fingers, while covering the remaining fingers and thumb completely. This invention protects the hand of the wearer by minimizing burning from a thermal styling tool.

Gloves are well known in the prior art and gloves exposing the wearer's fingers are not uncommon. For example, U.S. Pat. No. 5,330,391, issued Jul. 19, 1994 to Kenneth R. Mitchell discloses a glove that partially exposes certain fingers of the wearer, covering the remaining fingers completely. Similarly, U.S. Pat. No. 5,276,922 issued Jan. 11, 1994 to George Floyd, Jr., discloses a glove that exposes only a portion of the wearer's fingers as well as the thumb.

It should be noted that neither of the foregoing gloves, taken either singly or in combination, is seen to describe the instant invention as claimed.

SUMMARY OF THE INVENTION

The cosmetology thermal styling glove minimizes burning of the thumb and the first finger during thermal styling hair. The glove completely covers at least the thumb and the first finger while rendering all or less than all of the remaining fingers completely uncovered, allowing them to be in contact with the hair.

The glove according to a preferred embodiment of the instant invention includes a principal portion which covers the palm side and back side of the wearer's hand, a first finger which covers the wearer's first finger completely, and a thumb which covers the wearer's thumb completely. The remaining fingers are completely uncovered, allowing the fingers of the wearer to be in contact with the hair. Alternatively, the glove may have finger extensions for the remaining fingers, leaving them partially exposed, while at the same time, allowing the finger ends of the user to be in contact with the hair. The palm side and the back side each may also have air ventilation openings which allow air to be in contact with the users hand, thus allowing the hand to remain cool during thermal styling. In a preferred embodiment, the glove has a wrist-encircling portion, which securely attaches the glove to the hand of the wearer, and may also have a loop for easy storage when not in use. The glove itself is preferably made of a stretchy, heat retarding, fluid repelling, lightweight material, which will allow it to conform to the shape of the hand of the wearer.

In another form, this invention also provides a thermal styling glove with a principal portion which covers the palm side and back side of the wearer's hand, a first finger which covers the wearer's first finger completely, and a thumb which covers the wearer's thumb completely. The remaining fingers are uncovered, either completely or partially, allowing the fingers of the wearer to be in contact with the hair. The palm side and the backside are independent of air ventilation openings. The glove has a wrist-encircling portion, which securely attaches the glove to the hand of the wearer and is independent of a hanging loop.

A large number of hair stylists experience burning of the fingers during thermal styling, even those who have many years of experience. Most suffer burning during periods when they have been very busy. The instant thermal styling glove is very efficient in preventing burning of the fingers and the thumb, and at the same time, easy to wear without becoming cumbersome to the stylist wearing the glove. Most hair stylists have occasion to use many different kinds of sprays and solutions during thermal styling, which cause certain fingers to become irritated. The thermal styling glove minimizes such burning and irritation.

The primary object of the invention is to provide an apparatus to minimize burning of the thumb and at least the first finger that holds the hair against the thermal styling tool. Another object of the preferred embodiment of the present invention is to provide a useful, yet practical thermal styling glove that is entirely machine washable. Another object of the preferred embodiment of the present invention is to provide a thermal styling glove that allows air ventilation to the rest of the hand, thus allowing the hand to remain cool during styling. A further object of the preferred embodiment of the present the invention is to provide a thermal styling glove that may be worn on either the left hand or the right hand. Yet another object of the preferred embodiment of the present invention is to provide a thermal styling glove that is lightweight and fashionable. Another object of the preferred embodiment of the present invention is to provide a thermal styling glove that is easy to store when not being used. The glove may be placed in a dry sterilize cabinet or hung by the hanging loop attached to the wrist portion when not in use.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 2:
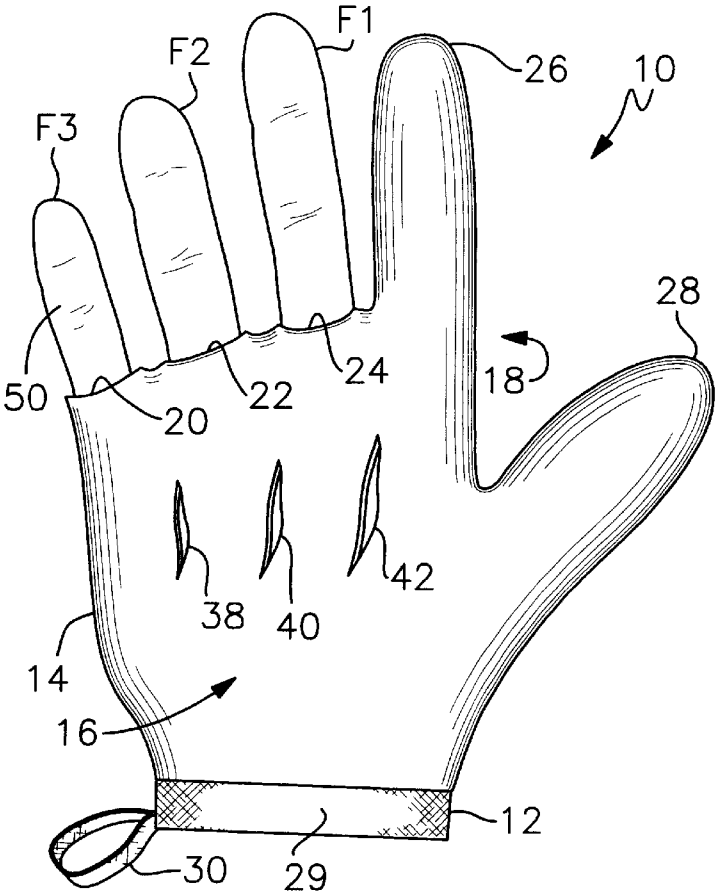
FIG. 2 is a top view of the palm side of the glove of FIG. 1.
Figure 1:
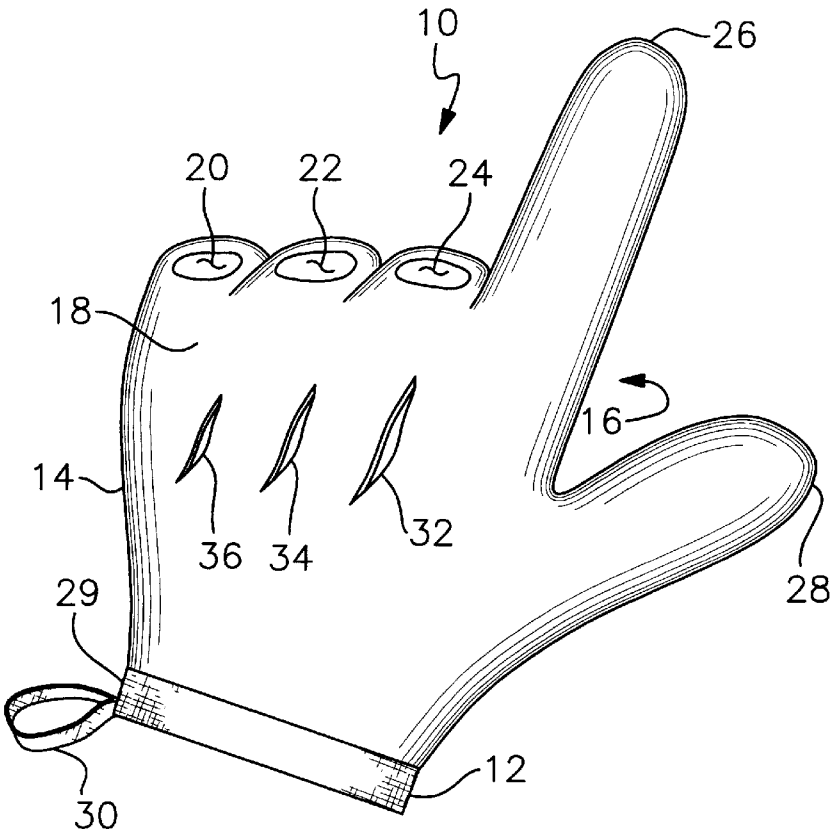
FIG. 1 is a perspective view of the backside of the cosmetology thermal styling glove of the preferred embodiment of the present invention.

As shown in FIGS. 1 and 2, the present invention is a cosmetology thermal styling glove 10 which completely covers at least the first finger and the thumb of the user, the three remaining fingers are uncovered allowing the remaining fingers to be in contact with the hair.

The glove 10 is suitable for a broad range of applications, depending upon the selection of the material used. In a preferred embodiment, the glove 10 is made of stretching material which allows the glove 10 to conform to the shape of the hand of the user, a fluid repelling material which allows the glove 10 to be self-sanitizing, an anti-flammable material, and a heat retarding material which helps the hand remain cool during thermal styling. The glove 10 may be worn on either the left hand or the right hand. The glove 10 includes a wrist encircling portion 12, a principal portion 14, which includes a palm side 16, and a back side 18, a permanently attached first finger portion 26, and a permanently attached thumb portion 28. The remaining three finger openings 20, 22, 24 allow fingers F1, F2, and F3 to be completely uncovered to allow fingers F1, F2, and F3 to be in contact with the hair during thermal styling.

The wrist encircling portion 12, is integral with the principal portion 14 and is provided with a means of securing 29 glove 10 to hand of user. Means of securing 29 is preferably an elastic band, but may be other means such as strap, hook, zipper, button, snap, or hook pile and loop pile (Velcro). The wrist-encircling portion 12, is integral with the principal portion 14 and is provided with a loop 30, for hanging storage when not in use.

The principal portion 14, includes three openings 32, 34, 36 on the back side 18, and three openings 38, 40, 42 on the palm side 16, which allow air to come in contact with the users hand 50, thus allowing the hand to remain cool during styling.

Figure 3:
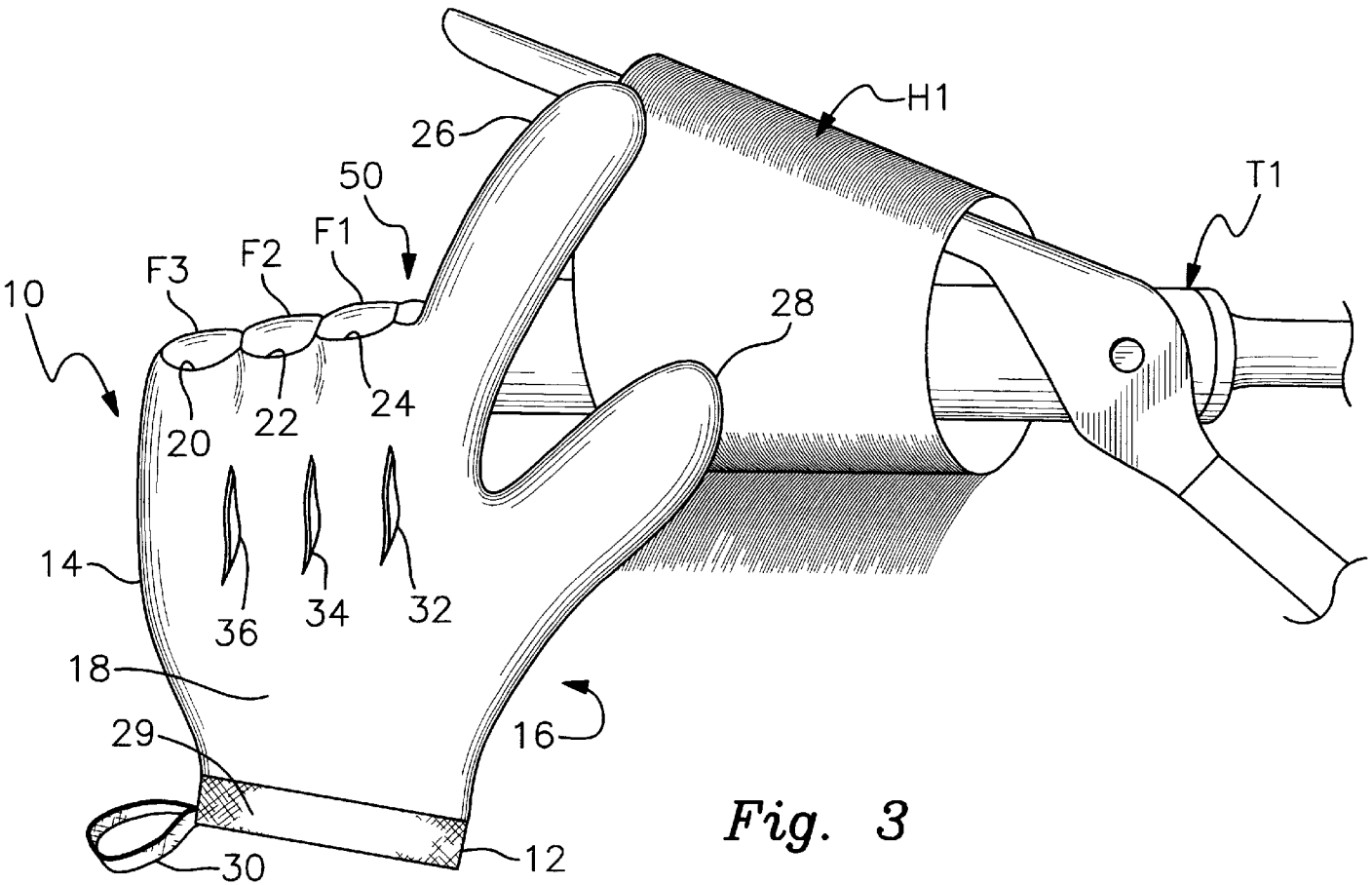
FIG. 3 is a perspective view of the glove of FIG. 1 in use on hair of a client by a user.

FIG. 3 illustrates the cosmetology thermal styling glove 10 in use on client's hair. Glove 10 is placed on hand 50. Elastic band 29 secures glove 10 to hand 50 of user. Fingers F1, F2, and F3 extend through openings 20, 22, and 24 of glove 10, so as to allow the fingers F1, F2, and F3 to be in contact with hair H1 when necessary (not shown). Direct contact with hair H1 allows the user to manipulate the hair with ease. First finger portion 26 and thumb portion 28 completely cover first finger and thumb of user so as to minimize burning while holding the hair against the thermal styling tool T1 as shown. Openings 32, 34, and 36 allow air to be in contact with users hand 50, which allows the hand 50 to remain cool during the thermal styling process.

Figure 4:
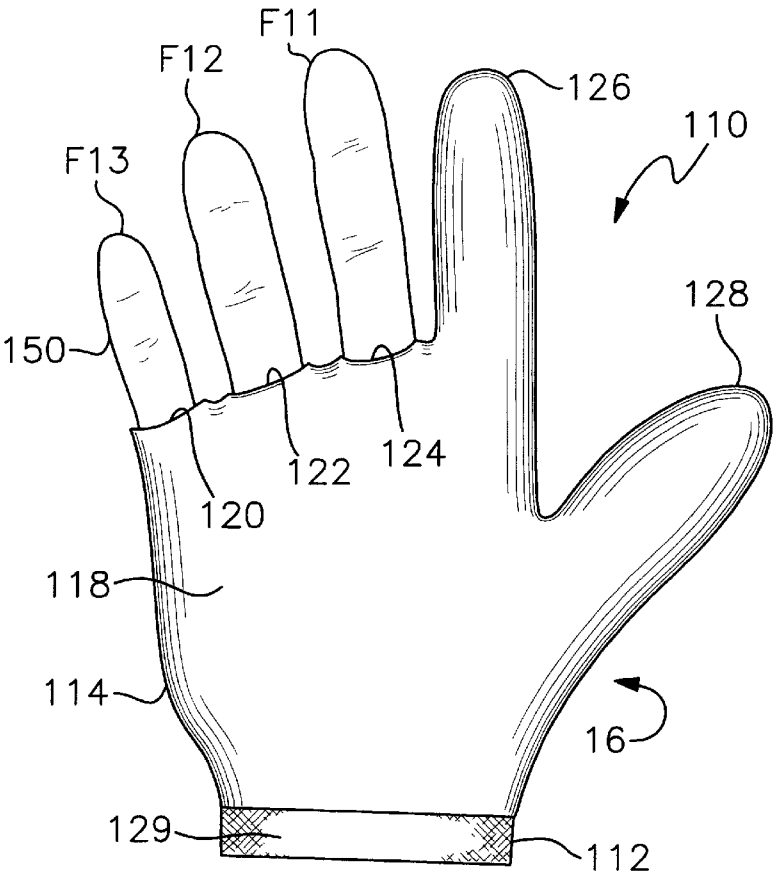
FIG. 4 is a top view of a second embodiment of the cosmetology thermal styling glove covering the thumb and the first finger leaving the other fingers completely uncovered.

FIG. 4 illustrates the cosmetology thermal styling glove 110 in an alternative form for use independent of openings on the palm side 118 and the backside 116. Also, independent of a hanging loop.

Figure 5:
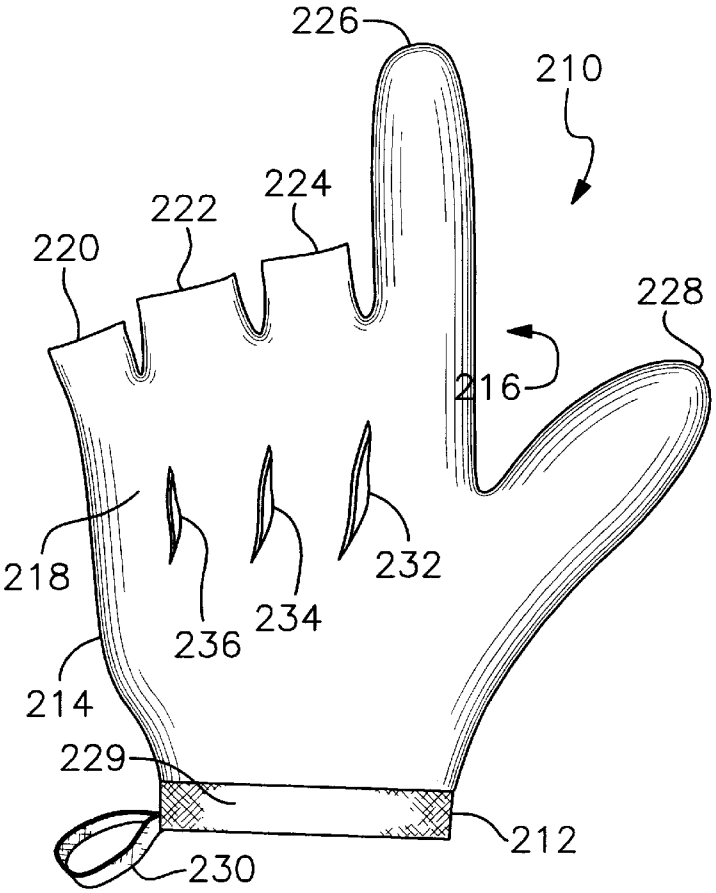
FIG. 5 is a top view of a third embodiment of the cosmetology thermal styling glove covering the thumb and the first finger completely while adding finger extensions, leaving the remaining fingers partially uncovered exposing finger ends.

FIG. 5 illustrates the cosmetology thermal styling glove 210 in an alternative form for use with finger extensions 220, 222, and 224 for partially covering exposed fingers, allowing finger ends to be in contact with hair of the client.

Figure 6:
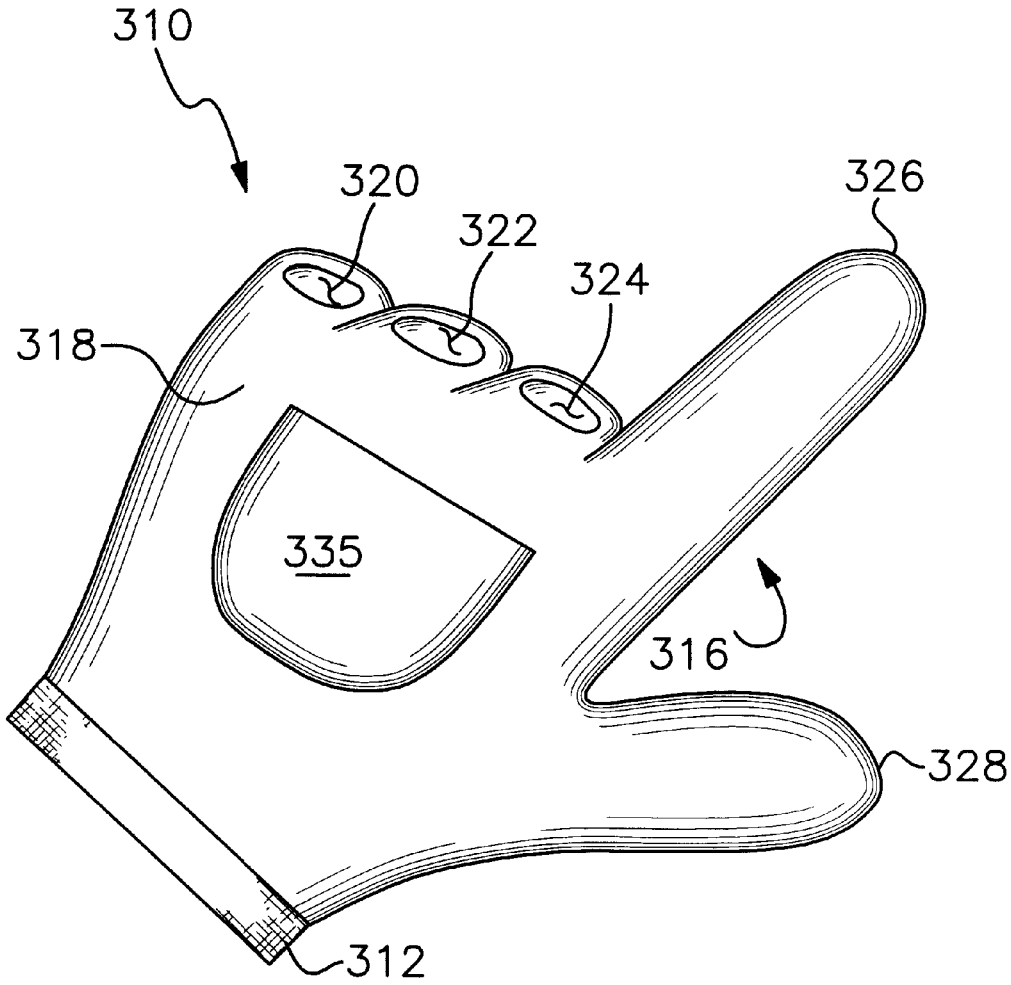
FIG. 6 is a perspective view of the backside of a another embodiment of the cosmetology thermal styling glove covering the thumb and the first finger leaving the other fingers completely uncovered, and incorporating a large opening on the backside for air ventilation.

FIG. 6 illustrates the cosmetology thermal styling glove 310 in an alternative embodiment with a large singular opening 335 on backside 316 and alternately on palm side 318 of glove 310, to allow air to be in contact with hand of the user, thus allowing hand to remain cool during thermal styling. Also, alternately independent of a hanging loop for easy storage.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A cosmetology thermal styling glove comprising:

a principal portion having a palm side and a back a wrist encircling portion being integral with said principal portion, a permanently attached thumb portion for covering the thumb, said thumb portion being attached to said principal portion of said glove, a permanently attached fore finger portion for covering the fore finger, said fore finger portion being attached to principal portion of said glove, and a middle finger portion, a ring finger portion, and a pinkie finger portion which are truncated at the base of the finger portions that allow the fingers to be uncovered forming webbed finger portions to allow the users fingers to be in contact with the hair.

2. A cosmetology thermal styling glove as claimed in claim 1 wherein said wrist encircling portion includes a means for securing glove to hand of wearer.

3. A cosmetology thermal styling glove as claimed in claim 2 wherein said wrist-encircling portion includes a loop for easy storage when not in use.

4. A cosmetology thermal styling glove as claimed in claim 1 wherein said webbed finger portions for the uncovered fingers secure and protect the back side and the palm side of the hand of the user.

5. A cosmetology thermal styling glove as claimed in claim 1 wherein said glove is comprised of stretching material to conform to the shape of the hand of the user.

6. A cosmetology thermal styling glove as claimed in claim 1 wherein said glove is comprised of fluid repelling material.

7. A cosmetology thermal styling glove as claimed in claim 1 wherein said glove is comprised of anti-flammable material.

8. A cosmetology thermal styling glove as claimed in claim 1 wherein said glove is comprised of heat retarding material.

* * * * *